US007694696B2

(12) United States Patent
Chang et al.

(10) Patent No.: US 7,694,696 B2
(45) Date of Patent: Apr. 13, 2010

(54) 3D FABRIC AND PREPARING THEREOF

(75) Inventors: Hoo-Sung Chang, Seoul (KR); Il-Sun Ryu, Daegu (KR)

(73) Assignees: Woongjin Chemical Co., Ltd., Seoul (KR); Youil Corporation Co., Ltd., Daegu (KR)

( * ) Notice: Subject to any disclaimer, the term of this patent is extended or adjusted under 35 U.S.C. 154(b) by 0 days.

(21) Appl. No.: 12/307,664

(22) PCT Filed: Apr. 11, 2008

(86) PCT No.: PCT/KR2008/002049

§ 371 (c)(1),
(2), (4) Date: Jan. 6, 2009

(87) PCT Pub. No.: WO2008/127030

PCT Pub. Date: Oct. 23, 2008

(65) Prior Publication Data

US 2009/0288731 A1 Nov. 26, 2009

(30) Foreign Application Priority Data

Apr. 12, 2007 (KR) ..... 10-2007-0036199

(51) Int. Cl.
*D03D 15/04* (2006.01)
*D03D 9/00* (2006.01)
*D03D 25/00* (2006.01)

(52) U.S. Cl. ..... 139/423; 139/383 R; 139/384 A; 139/420 R

(58) Field of Classification Search ..... 139/383 R, 139/384 R, 387 R, 384 A, 391, 394, 408, 139/410, 411, 412, 413, 420 R, 423, DIG. 1
See application file for complete search history.

(56) References Cited

U.S. PATENT DOCUMENTS 3,145,446 A * 8/1964 Sussman ..... 28/159

(Continued)

FOREIGN PATENT DOCUMENTS

JP 2001-172841 A 6/2001

(Continued)

OTHER PUBLICATIONS

International Preliminary Report and Written Opinion, corresponding to PCT/KR2008/002049 dated Oct. 13, 2009.

*Primary Examiner*—Bobby H Muromoto, Jr.
(74) *Attorney, Agent, or Firm*—Sughrue Mion, PLLC

(57) ABSTRACT

A three-dimensional multilayer fabric is provided. The fabric comprises a surface layer, a backing layer, and an intermediate layer connecting the surface layer and the backing layer. The surface layer includes sequential unstitched surface portions and sequential stitched surface portions formed in an alternating and repeating pattern. The unstitched surface portions of the surface layer are essentially composed of surface warp threads only, and the stitched surface portions of the surface layer are composed of the surface warp threads and intermediate warp threads. The backing layer includes sequential unstitched backing portions and sequential stitched backing portions formed in an alternating and repeating pattern. The unstitched backing portions of the backing layer are essentially composed of backing warp threads only, and the stitched backing portions of the backing layer are composed of the backing warp threads and the intermediate warp threads. The intermediate warp threads are woven without interlacing with weft threads on the surfaces of the unstitched backing portions. The intermediate layer includes sequential intermediate portions composed of the intermediate warp threads only. Each of the intermediate portions consists of a first intermediate portion and a second intermediate portion connected to the stitched surface portions and the stitched backing portions in an alternating and repeating pattern. The connecting warp threads of the intermediate layer exposed to the outside of the backing layer are sheared. Further provided is a method for the production of the fabric.

49 Claims, 8 Drawing Sheets

U.S. PATENT DOCUMENTS 3,328,218 A * 6/1967 Noyes ..... 156/166
3,384,519 A * 5/1968 Froget ..... 156/65
3,664,907 A * 5/1972 Price ..... 428/57
4,137,111 A 1/1979 Hansen
4,386,454 A 6/1983 Hopper
5,188,160 A 2/1993 Jelic
5,205,891 A 4/1993 Neff
5,228,936 A * 7/1993 Goodhue ..... 156/260
5,287,908 A 2/1994 Hoffmann et al.
5,313,999 A 5/1994 Colson et al.
5,320,154 A 6/1994 Colson et al.
5,339,882 A 8/1994 Judkins
5,339,883 A 8/1994 Colson et al.
5,392,832 A 2/1995 Colson et al.
5,394,922 A 3/1995 Colson et al.
5,405,483 A 4/1995 Neff
5,419,385 A 5/1995 Vogel et al.
5,451,448 A * 9/1995 Sawko et al. ..... 428/175
5,454,414 A 10/1995 Colson et al.
5,456,304 A 10/1995 Colson et al.
5,490,553 A 2/1996 Colson et al.
5,503,210 A 4/1996 Colson et al.
5,558,925 A 9/1996 Fritzman
5,601,129 A 2/1997 Colson et al.
5,603,369 A 2/1997 Colson et al.
5,616,399 A * 4/1997 Theisen ..... 428/175
5,620,035 A 4/1997 Judkins
5,638,880 A 6/1997 Colson et al.
5,657,795 A * 8/1997 Sawko et al. ..... 139/11
5,664,613 A 9/1997 Jelic
5,713,407 A 2/1998 Judkins
5,714,034 A * 2/1998 Goodhue ..... 156/512
5,718,799 A 2/1998 Colson et al.
5,845,690 A 12/1998 Colson et al.
5,855,235 A 1/1999 Colson et al.
5,888,639 A 3/1999 Green et al.
5,897,731 A 4/1999 Colson et al.
6,001,199 A 12/1999 Colson et al.
6,024,819 A 2/2000 Corey
6,033,504 A 3/2000 Judkins
6,045,890 A 4/2000 Green et al.
6,068,008 A 5/2000 Caldwell
6,068,039 A 5/2000 Judkins
6,112,797 A 9/2000 Colson et al.
6,164,363 A 12/2000 Colson et al.
6,171,424 B1 1/2001 Barss
6,196,291 B1 3/2001 Rupel et al.
6,284,347 B1 9/2001 Green et al.
6,302,982 B1 10/2001 Corey et al.
D456,196 S 4/2002 Colson et al.
6,377,384 B2 4/2002 Corey et al.
6,440,247 B2 8/2002 Rupel et al.
6,484,786 B1 11/2002 Ruggles et al.
6,537,640 B1 * 3/2003 Nakamura et al. ..... 428/92
6,572,725 B2 * 6/2003 Goodhue ..... 156/256
6,575,222 B2 6/2003 Corey et al.
6,634,409 B2 10/2003 Corey et al.
6,688,369 B2 2/2004 Colson et al.
6,688,370 B1 2/2004 Nien
6,772,815 B1 8/2004 Judkins
6,823,923 B2 11/2004 Palmer et al.
6,854,388 B2 * 2/2005 Herhold et al. ..... 101/211
6,908,661 B2 6/2005 Green et al.
7,059,378 B2 6/2006 Colson et al.
7,128,121 B2 10/2006 Nien
7,169,459 B2 1/2007 Lichodziejewski et al.
7,194,846 B2 3/2007 Swiszcz et al.
7,207,151 B2 4/2007 Swiszcz et al.
7,303,641 B2 12/2007 Swiszcz et al.
7,377,084 B2 5/2008 Swiszcz et al.
7,398,624 B2 7/2008 Swiszcz et al.
2007/0028997 A1 * 2/2007 Best et al. ..... 139/383 R
2009/0224521 A1 * 9/2009 Huber ..... 280/743.1

FOREIGN PATENT DOCUMENTS

JP 2002-054050 A 2/2002
KR 10-0233069 B1 12/1999

* cited by examiner

[Fig. 1]
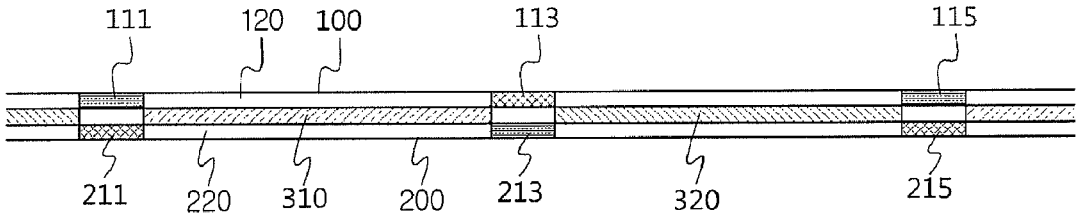
[Fig. 2]
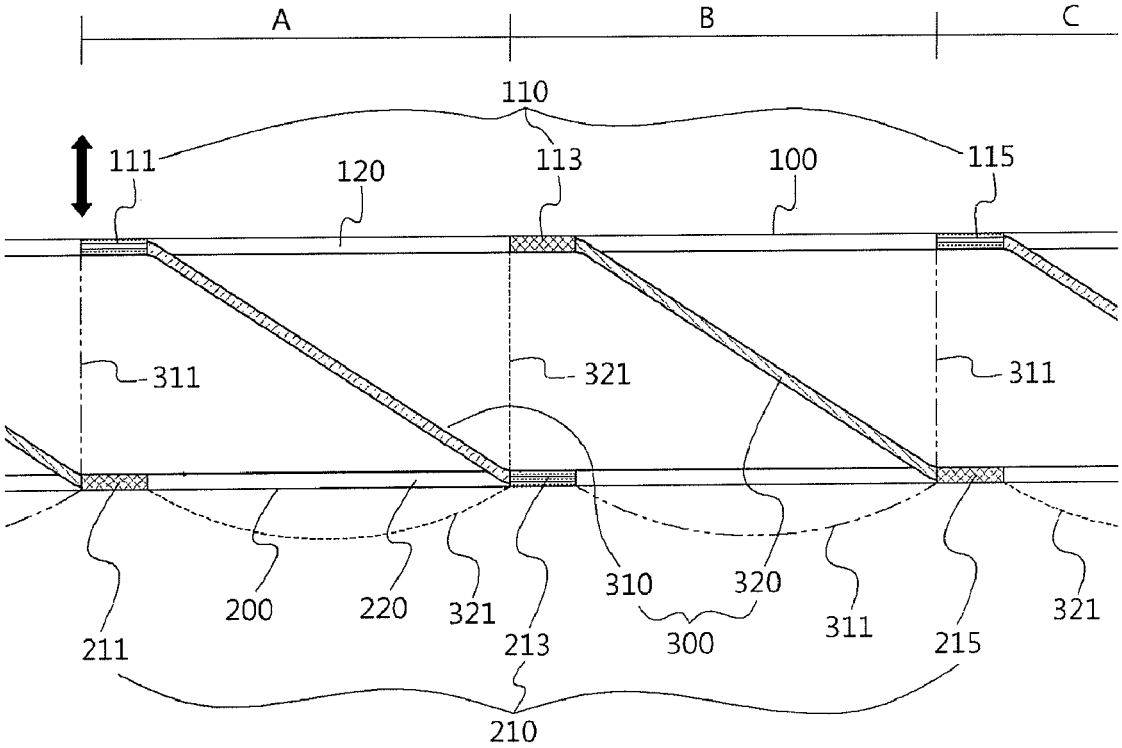

[Fig. 3]
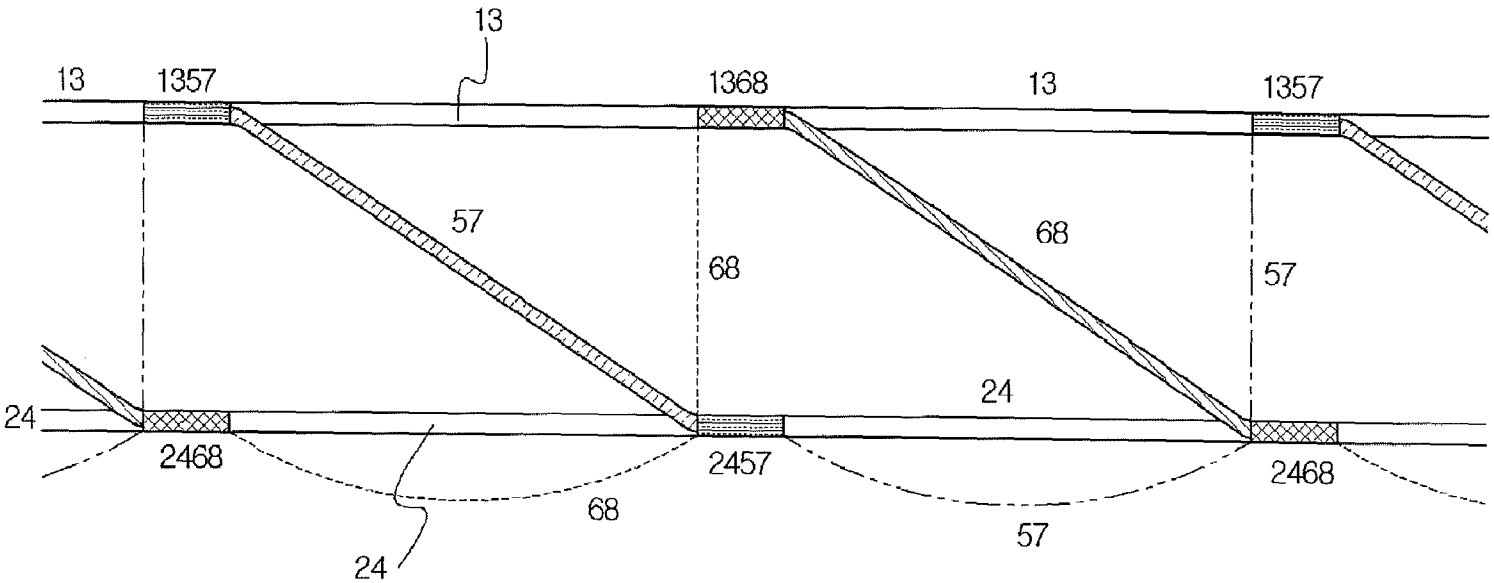

[Fig. 4]
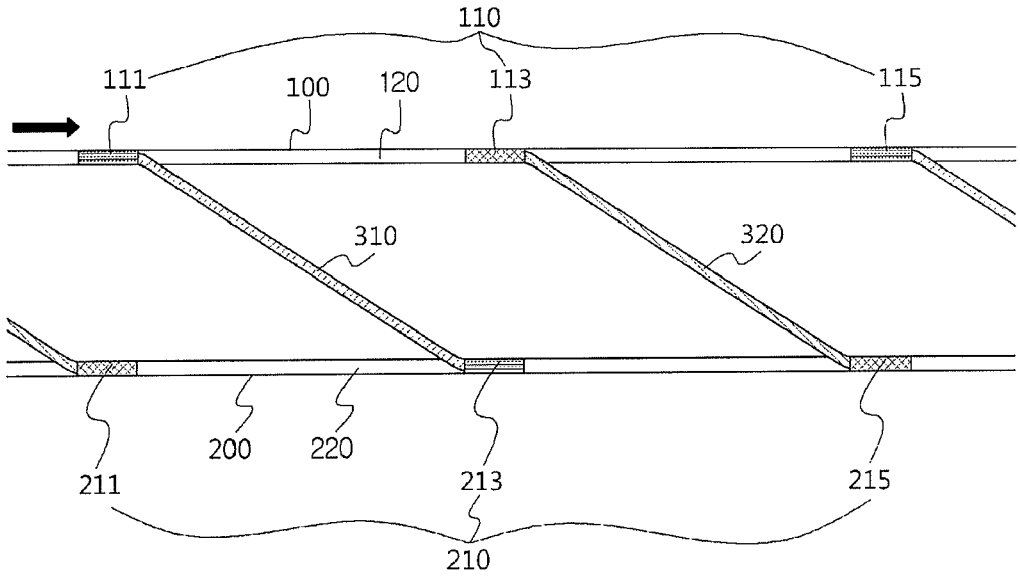
[Fig. 5]
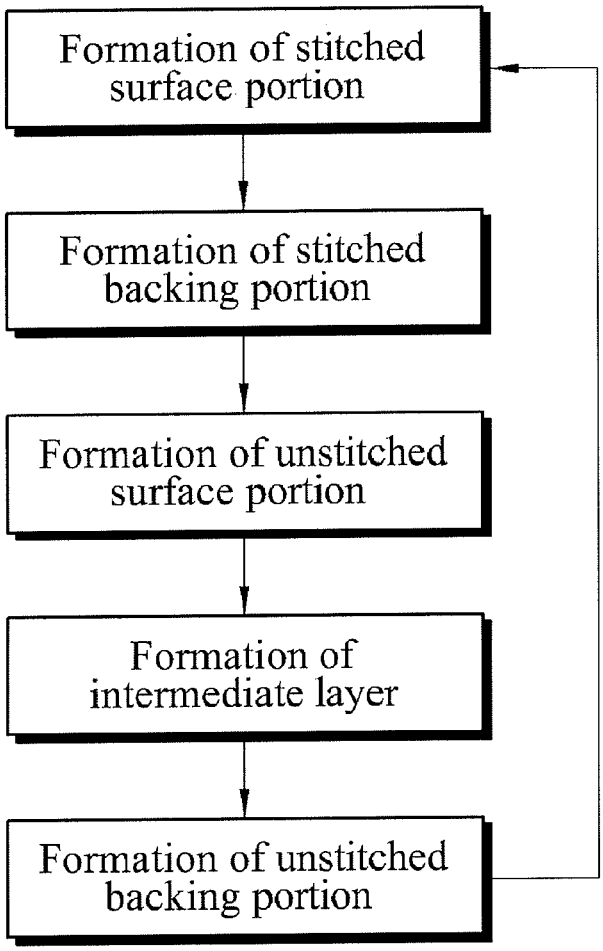

[Fig. 6]
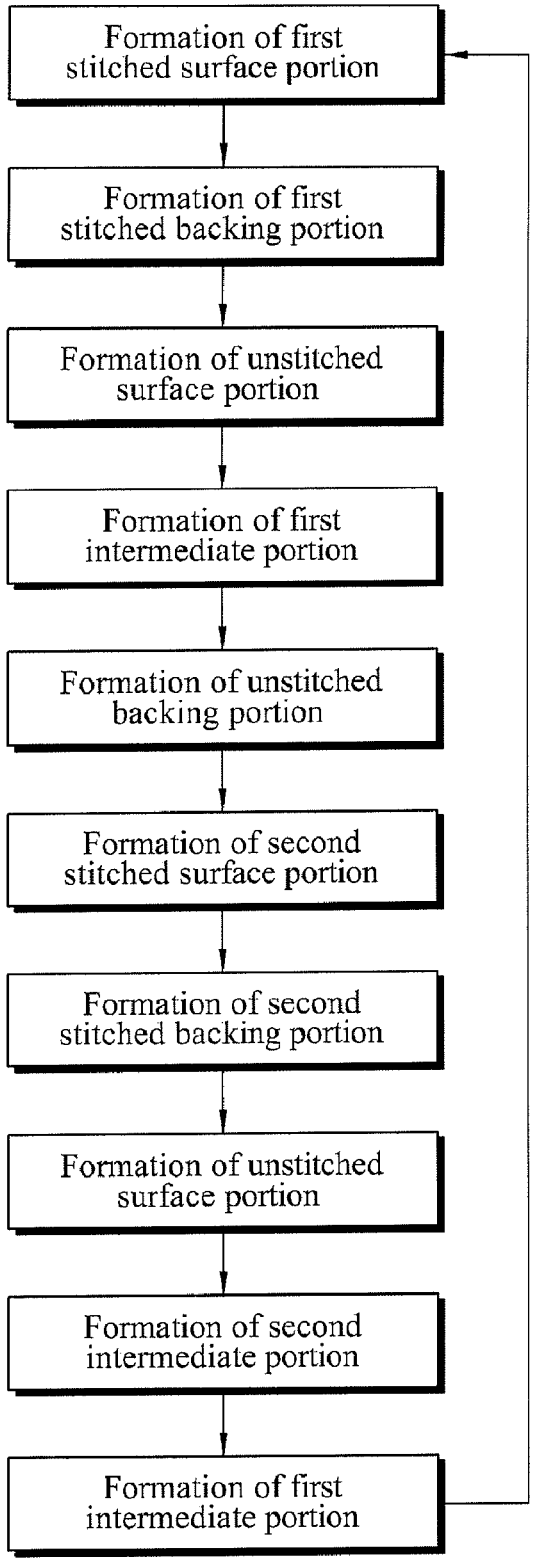

[Fig. 7]
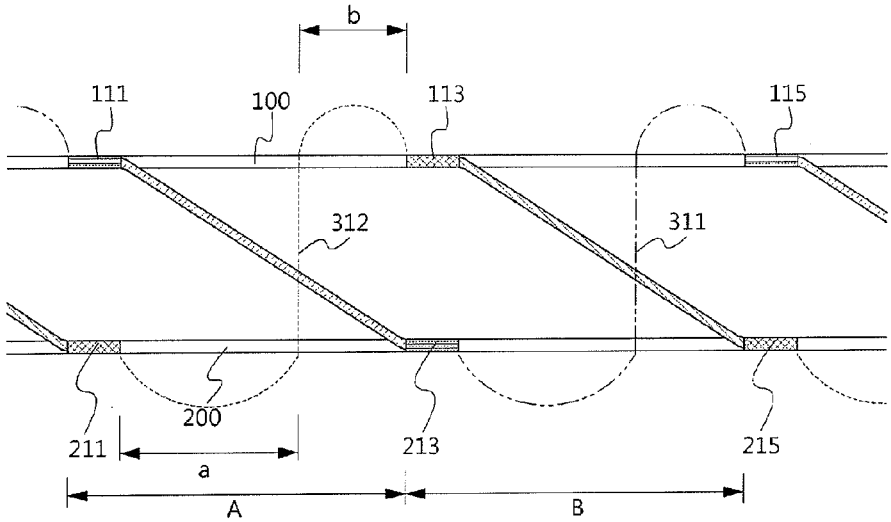
[Fig. 8]
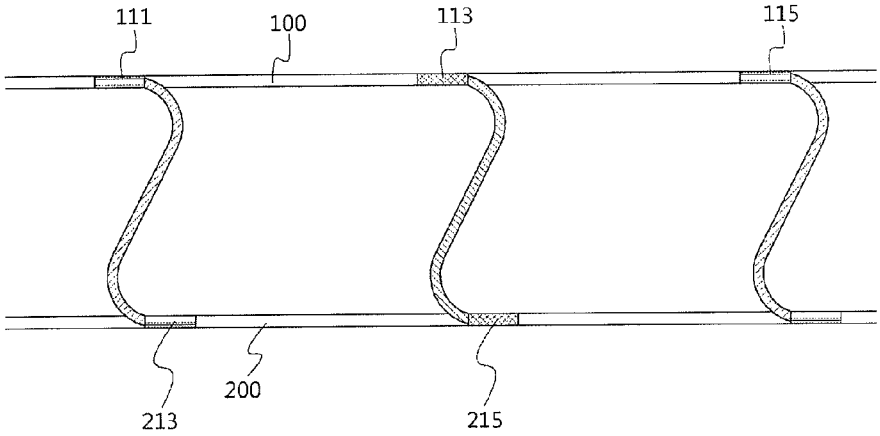
[Fig. 9]
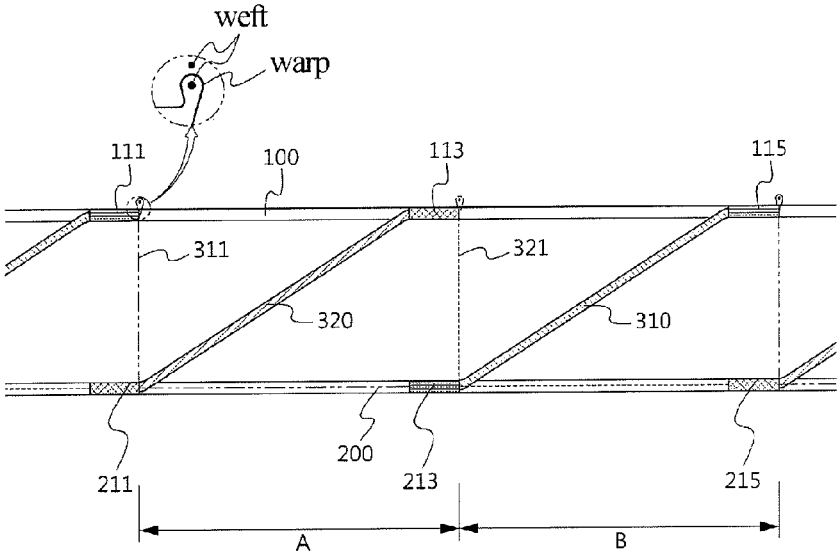

[Fig. 10]
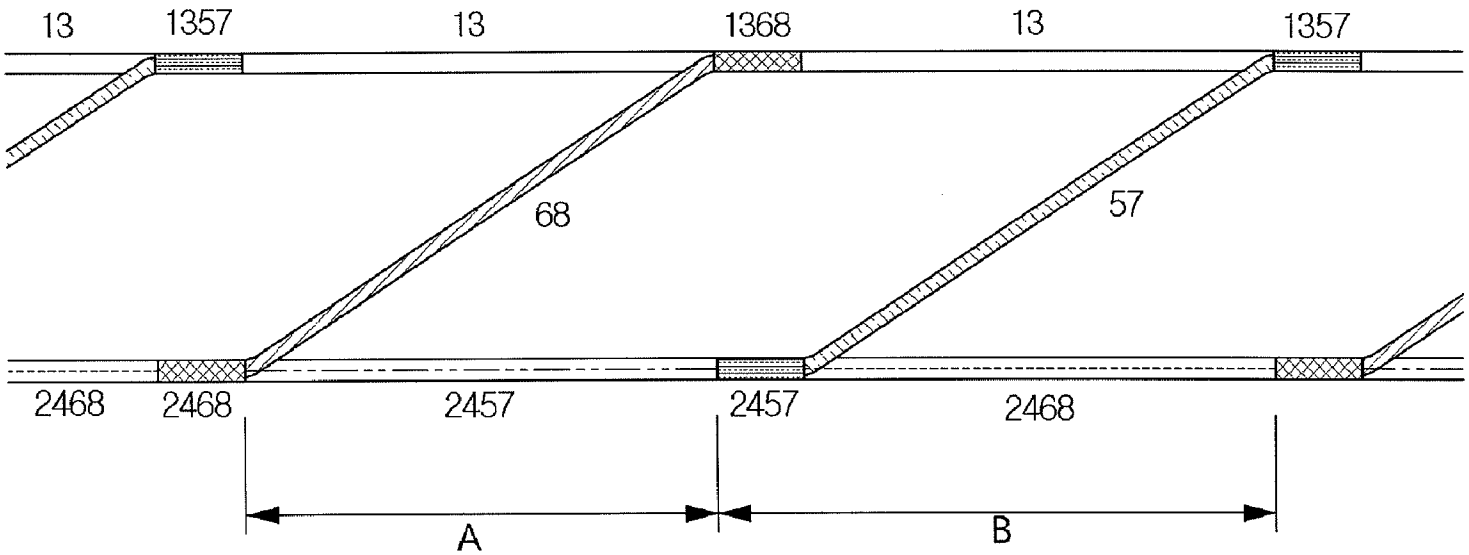

[Fig. 11]
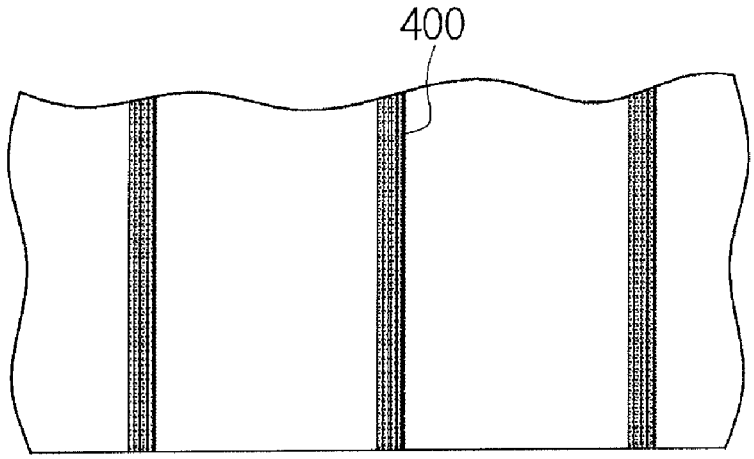
[Fig. 12]
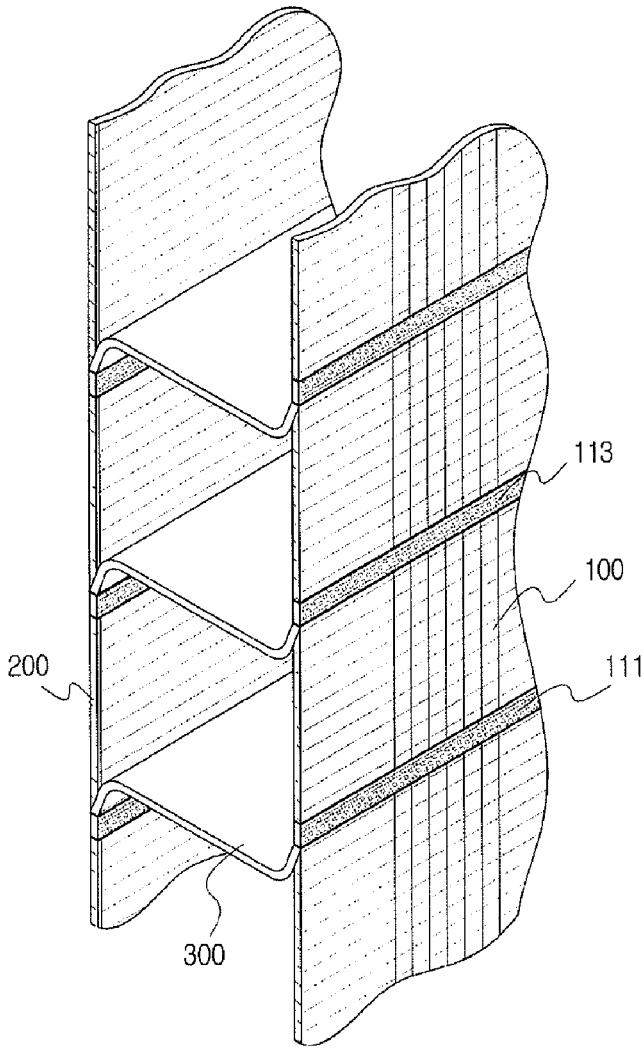

[Fig. 13]
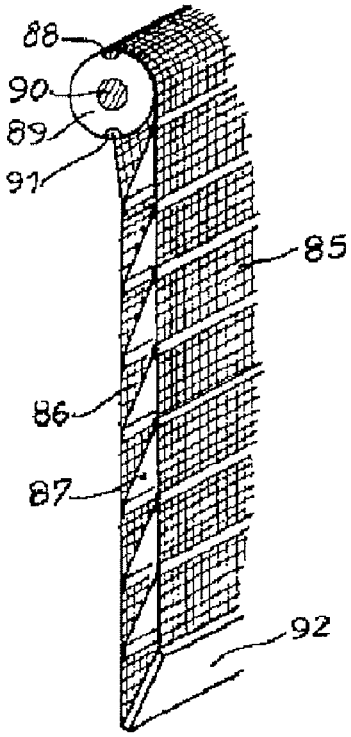
[Fig. 14]
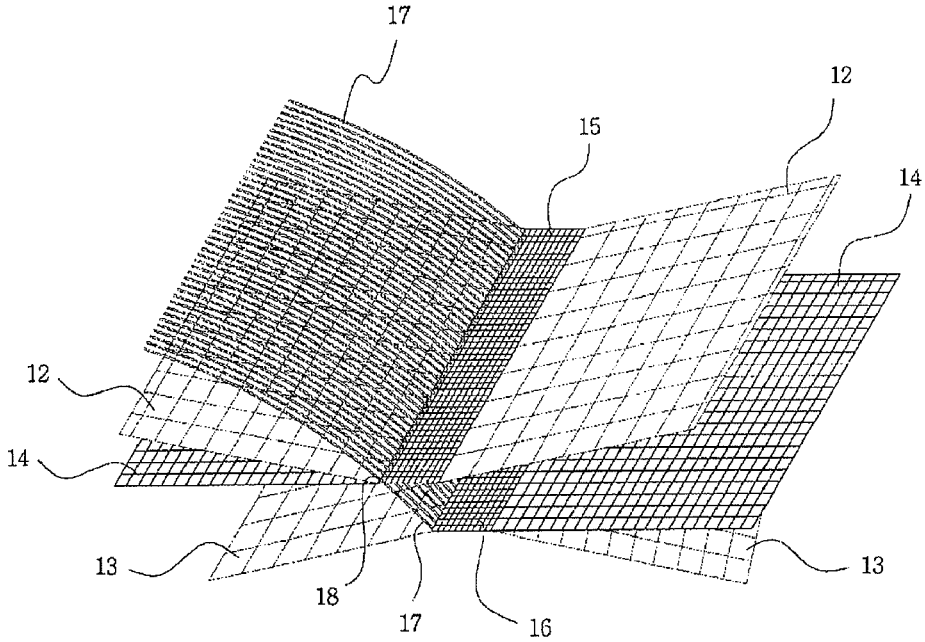

3D FABRIC AND PREPARING THEREOF

TECHNICAL FIELD

The present invention relates to fabrics that can create three-dimensional shapes and methods for the production of the fabrics. More specifically, the present invention relates to fabrics, particularly fabrics applicable as materials for window blinds, that can be woven on a single loom in a batch operation by novel weaving techniques and undergo transformation between two-dimensional and three-dimensional shapes, and methods for the production of the fabrics.

BACKGROUND ART

Fabrics are typically made from corresponding raw materials and are constructed by weaving, knitting, plaiting or braiding. For example, felt fabrics are produced by the interlocking of fibers. Fabrics are primarily classified into woven fabrics, knitted fabrics, felt fabrics, plaited fabrics, non-woven fabrics, laminated fabrics and molded fabrics by standard production methods thereof.

In a narrow sense, woven fabrics refer to fabrics constructed by interlacing vertical warp threads with horizontal weft threads at right angles. Woven fabrics are the most widely used fabrics for under wears and outer wears. Knitted fabrics are constructed by making sets of threads into loops and combining the loops with one another in forward, backward, left and right directions. Knitted fabrics are rapidly produced by knitting and tend to be loose and elastic when being worn. Strands of fibers are interlocked by heat, moisture, pressure or striking to construct felt fabrics, thus eliminating the need for the use of threads. In plaited, braided and lace fabrics, individual threads are interlaced with sets of threads while sliding in any one direction to attain desired effects. Non-woven fabrics are constructed by the application of adhesive materials, the attachment of fibers through chemical functions on the surface of the fibers, or the attachment of webs or sheets of thermoplastic fibers by heating. Laminated fabrics are constructed by laminating a foam to one or two woven fabrics to achieve improved flexibility and provide a cushiony feeling. The surface areas of molded fabrics are larger than those of the raw materials before extrusion. Molded articles (e.g., clothes) are cushiony, or are in the form of a pile or plate. These articles are very wearable, match the functions of the human body, and are not readily deformed.

The lateral sides of two-dimensional fabrics are not utilized or used. Sewing and other fusion techniques are currently used to impart three-dimensional shapes to fabrics.

Industrial applications of such techniques have been reported. For example, U.S. Pat. No. 3,384,519 suggests a blind comprising fabrics 85 and 86 and a movable blade 87 positioned between the fabrics wherein the fabrics are adhered to the blade by fusion or bonding (see, FIG. 13). The horizontal movement of the blade allows light to enter through the mesh type fabrics, and the vertical movement of the blade blocks light. By the movements of the blade, the amount of light entering the blind can be controlled. In addition, the soft texture and mesh structure of the fabrics enable the blind to shield light in a controllable manner. However, the use of an adhesive or pressure-sensitive adhesive for the adhesion of the blade to the fabrics may cause the problems of indoor environmental pollution. Particularly, long-term use of the blind causes a deterioration in the physical properties of the adhesive or pressure-sensitive adhesive by UV light, resulting in poor adhesion between the blade and the fabrics. In serious cases, the blade is separated from the fabrics.

In an attempt to overcome the above problems, a roll screen and a roll blind are suggested in Korean Patent No. 699769. Specifically, the blind is produced using a single fabric woven by warp threads and weft threads as connecting means. A front mesh type curtain sheet 12, a rear mesh type curtain sheet 13 and a light-shielding curtain sheet 14 are integrally formed in the blind. The mesh type curtain sheets serve to control the amount of air flowing through and light entering the blind, and the light-shielding curtain sheet serves to block light entering the blind. More specifically, the blind is configured such that the front mesh type curtain sheet 12, the rear mesh type curtain sheet 13 and the light-shielding curtain sheet 14 are integrated by connecting weft threads 17 woven together with front connecting knots 15 and rear connecting knots 16. The light-shielding curtain sheet 14 is woven between the front mesh type curtain sheet 12 and the rear mesh type curtain sheet 13 by repeatedly connecting and fixing the light-shielding curtain sheet 14 to the front mesh type curtain sheet 12 and the rear mesh type curtain sheet 13 while integrally bonding the connecting weft threads 17 to warp threads by weaving, passing the connecting weft threads 17 from the rear connecting knots 16 through grooves 18 formed in the front connecting knots 15, and repeatedly weaving the end portions of the connecting weft threads 17 integrally bonded to the front mesh type curtain sheet 12 with the warp threads of the rear connecting knots 16 to form several connecting knots.

The front mesh type curtain sheet 12 and the rear mesh type curtain sheet 13 are connected by the weft threads to construct the multilayer fabric. This requires the removal of the weft threads in order to create a three-dimensional shape. Further, the front mesh type curtain sheet 12, the rear mesh type curtain sheet 13, the light-shielding curtain sheet 14, the front connecting knots 15 and the rear connecting knots 16 are not woven together in the multilayer fabric. Instead, the front connecting knots 15 are formed by integrating the front mesh type curtain sheet 12, the light-shielding curtain sheet 14 and the weft threads 17, and the rear connecting knots 16 are formed by integrating the rear mesh type curtain sheet 13, the light-shielding curtain sheet 14 and the weft threads 17.

The greatest problem of the patent is that the blind contradicts the fundamental theory of weaving. Weaving is a technique by which warp threads and weft threads are interlaced on a loom to construct a fabric. Specifically, the construction of a fabric by weaving is achieved by winding warp threads on a warper, drawing-in the warp threads, moving the drawn-in warp threads upwardly and downwardly (i.e. shedding motion) on a loom to form openings, and passing weft threads between the openings. In view of the foregoing, weft threads must be moved upwardly and downwardly (shedding motion) to accomplish the patented blind. In actuality, however, the weaving technique is impossible to realize. Therefore, the patented blind is considered to be incomplete.

DISCLOSURE OF INVENTION

Technical Problem

The present invention has been made in an effort to solve the above problems, and it is one object of the present invention to provide a fabric that can create a three-dimensional shape without the use of any adhesive or pressure-sensitive adhesive, and a method for producing the fabric.

It is a further object of the present invention to provide a fabric that can create a three-dimensional shape and whose design or color depth can be changed depending on the variation in three-dimensional shape, and a method for producing the fabric.

It is another object of the present invention to provide a fabric that uses fine denier yarns to create a three-dimensional shape, and a method for producing the fabric.

It is another object of the present invention to provide a fabric that has the ability to block incident light in a controllable manner depending on the variation in three-dimensional shape, and a method for producing the fabric.

It is still another object of the present invention to provide a fabric whose flexibility is ensured and whose shape stability is maintained to find use in industrial applications, such as blinds, and a method for producing the fabric.

Technical Solution

In accordance with one aspect of the present invention, the above objects can be accomplished by the provision of a three-dimensional multilayer fabric, comprising a surface layer, a backing layer and an intermediate layer connecting the surface layer and the backing layer wherein the surface layer includes sequential unstitched surface portions and sequential stitched surface portions formed in an alternating and repeating pattern, the unstitched surface portions being essentially composed of surface warp threads only and the stitched surface portions being composed of the surface warp threads and intermediate warp threads; the backing layer includes sequential unstitched backing portions and sequential stitched backing portions formed in an alternating and repeating pattern, the unstitched backing portions being essentially composed of backing warp threads only and the stitched backing portions being composed of the backing warp threads and the intermediate warp threads; and the intermediate layer includes sequential intermediate portions composed of the intermediate warp threads only, each of the intermediate portions consisting of a first intermediate portion and a second intermediate portion connected to the stitched surface portions and the stitched backing portions in an alternating and repeating pattern, the intermediate warp threads being woven without interlacing with weft threads on the surfaces of the unstitched backing portions and exposed to the outside, followed by shearing.

In an embodiment of the present invention, each of the first and second intermediate portions of the intermediate layer is connected to the corresponding stitched surface portion and the subsequent stitched backing portion of the stitched backing portion lying on the same vertical line as the stitched surface portion.

In a further embodiment of the present invention, the surface warp threads are woven with the first intermediate warp threads to form the first stitched surface portion, and the first intermediate warp threads only are woven to form the intermediate layer and are woven with the backing warp threads to form the second stitched backing portion.

In another embodiment of the present invention, the first intermediate warp threads are woven without interlacing with the weft threads, where the backing warp threads only are woven to form the unstitched backing portions.

In another embodiment of the present invention, the connecting warp threads of the first intermediate portion connect the starting point of the third stitched backing portion to the starting point of the third stitched surface portion and are woven together with the surface warp threads to form the third stitched surface portion.

In another embodiment of the present invention, the first stitched backing portion of the backing layer is formed at the same vertical position as the first stitched surface portion and is composed of the backing warp threads and the second intermediate warp threads, and the second intermediate warp threads are woven without interlacing with the weft threads, where the backing warp threads only are interlaced with the weft threads to form the backing layer.

In another embodiment of the present invention, the connecting warp threads of the second intermediate portion are woven together with the surface warp threads at the starting point of the second stitched backing portion to form the second stitched surface portion of the surface layer.

In another embodiment of the present invention, the second intermediate warp threads having participated in the formation of the second stitched surface portion are woven to form the second intermediate portion and are woven together with the backing warp threads to form the third stitched backing portion.

In accordance with another aspect of the present invention, there is provided a three-dimensional multilayer fabric, comprising a surface layer, a backing layer and an intermediate layer connecting the surface layer and the backing layer wherein the surface layer includes sequential unstitched surface portions and sequential stitched surface portions, the backing layer includes sequential unstitched backing portions and sequential stitched backing portions, and the intermediate layer includes sequential intermediate portions, each consisting of a first intermediate portion and a second intermediate portion; and wherein when surface warp threads are 1/3, backing warp threads are 2/4, first intermediate warp threads are 5/7 and second intermediate warp threads are 6/8, as indicated by harness numbers, the unstitched surface portions and the unstitched backing portions are essentially composed of 1/3 and 2/4, respectively, the first and third stitched surface portions are composed of 1/3/5/7, and the second stitched surface portion is composed of 1/3/6/8, the first and third stitched backing portions of the baking layer are composed of 2/4/6/8, the second stitched backing portion is composed of 2/4/5/7, and the first and second intermediate portions are composed of 5/7 and 6/8, respectively, the connecting warp threads of the intermediate layer exposed to the outside of the backing layer being sheared.

In accordance with another aspect of the present invention, there is provided a method for the production of a three-dimensional multilayer fabric comprising a surface layer, a backing layer and an intermediate layer connecting the surface layer and the backing layer, the method comprising the steps of: interlacing surface warp threads and intermediate warp threads with weft threads while shedding along a harness to form a stitched surface portion; interlacing backing warp threads and the intermediate warp threads with the weft threads during shedding to form a stitched backing portion; interlacing the surface warp threads with the weft threads to form an unstitched surface portion; interlacing the intermediate warp threads with the weft threads to form the intermediate layer; interlacing the backing warp threads with the weft threads to form an unstitched backing portion; and sequentially repeating the above procedure as the pre-designed length and shearing the connecting warp threads of the intermediate layer exposed to the outside of the backing layer.

In an embodiment of the present invention, the intermediate layer includes sequential intermediate portions, each consisting of a first intermediate portion and a second intermediate portion, and in the step of forming the stitched surface portion, the surface warp threads and first intermediate warp threads are interlaced with the weft threads while shedding along the harness to form the first stitched surface portion.

In a further embodiment of the present invention, in the step of forming the stitched backing portion, the backing warp threads and second intermediate warp threads are interlaced with the weft threads during shedding to form the second stitched backing portion.

In another embodiment of the present invention, the step of forming the intermediate layer includes the sub-step of interlacing the first intermediate warp threads with the weft threads to form the first intermediate portion.

In another embodiment of the present invention, the step of forming the stitched surface portion includes the sub-step of weaving the second intermediate warp threads with the surface warp threads to form the second stitched surface portion.

In another embodiment of the present invention, the step of forming the stitched backing portion includes the sub-step of weaving the first intermediate warp threads with the backing warp threads to form the second stitched backing portion.

In accordance with another aspect of the present invention, there is provided a method for the production of a three-dimensional multilayer fabric comprising a surface layer, a backing layer, and an intermediate layer connecting the surface layer and the backing layer and including sequential intermediate portions, each of the intermediate portions consisting of a first intermediate portion and a second intermediate portion, the method comprising the steps of: weaving surface warp threads with first intermediate warp threads to form a first stitched surface portion and weaving the first intermediate warp threads only to form the first intermediate portion; weaving backing warp threads with second intermediate warp threads to form a first stitched backing portion at the same vertical position as the first stitched surface portion, and weaving the second intermediate warp threads without interlacing with the weft threads, where the backing warp threads only are interlaced with the weft threads to form the backing layer; weaving the connecting warp threads of the second intermediate portion with the surface warp threads at the starting point of a second stitched backing portion to form a second stitched surface portion of the surface layer, and weaving the second intermediate warp threads only to form the second intermediate portion; weaving the first intermediate warp threads with the backing warp threads to form a second stitched backing portion and weaving the first intermediate warp threads without interlacing with the weft threads, where the backing warp threads only are woven to form unstitched backing portions; and shearing the connecting warp threads of the intermediate layer exposed to the outside of the backing layer.

In an embodiment of the present invention, when the surface warp threads are 1/3, the backing warp threads are 2/4, the first intermediate warp threads are 5/7 and the second intermediate warp threads are 6/8, as indicated by harness numbers, the unstitched surface portion and the unstitched backing portion are essentially composed of 1/3 and 2/4, respectively, the first and third stitched surface portions are composed of 1/3/5/7, and the second stitched surface portion is composed of 1/3/6/8, the first and third stitched backing portions of the baking layer are composed of 2/4/6/8, the second stitched backing portion is composed of 2/4/5/7, and the first and second intermediate portions are composed of 5/7 and 6/8, respectively.

In accordance with another aspect of the present invention, there is provided a three-dimensional multilayer fabric, comprising a surface layer, a backing layer and an intermediate layer connecting the surface layer and the backing layer wherein the surface layer includes sequential unstitched surface portions and sequential stitched surface portions formed in an alternating and repeating pattern, the unstitched surface portions being essentially composed of surface warp threads only and the stitched surface portions being composed of the surface warp threads and intermediate warp threads; the backing layer includes sequential unstitched backing portions and sequential stitched backing portions formed in an alternating and repeating pattern, the unstitched backing portions being essentially composed of backing warp threads only and the stitched backing portions being composed of the backing warp threads and the intermediate warp threads; and the intermediate layer includes sequential intermediate portions composed of the intermediate warp threads only, each of the intermediate portions consisting of a first intermediate portion and a second intermediate portion connected to the stitched surface portions and the stitched backing portions in an alternating and repeating pattern, the intermediate warp threads being woven without interlacing with weft threads on the surfaces of the unstitched backing portions and the unstitched surface portions and exposed to the outside, followed by shearing.

In an embodiment of the present invention, each of the first and second intermediate portions of the intermediate layer is connected to the corresponding stitched surface portion and the subsequent stitched backing portion of the stitched backing portion lying on the same vertical line as the stitched surface portion.

In a further embodiment of the present invention, the surface warp threads are woven with the first intermediate warp threads to form the first stitched surface portion, and the first intermediate warp threads only are woven to form the intermediate layer, and are woven with the backing warp threads to form the second stitched backing portion.

In another embodiment of the present invention, the first intermediate warp threads are woven without interlacing with the weft threads, where the backing warp threads only are woven to form the unstitched backing portions.

In another embodiment of the present invention, the connecting warp threads of the first intermediate portion move upwardly from any point of the unstitched backing portion between the second stitched backing portion and the third stitched backing portion to the unstitched surface portion between the second stitched surface portion and the third stitched surface portion and are woven without interlacing with the weft threads till the starting point of the third stitched surface portion.

In another embodiment of the present invention, the first stitched backing portion of the backing layer is formed at the same vertical position as the first stitched surface portion and is composed of the backing warp threads and the second intermediate warp threads, the backing warp threads only are woven to form the unstitched backing portions, and the second intermediate warp threads are woven without interlacing with the weft threads.

In another embodiment of the present invention, the second intermediate warp threads move upwardly from any point of the unstitched backing portion between the first stitched backing portion and the second stitched backing portion to the unstitched surface portion between the first stitched surface portion and the second stitched surface portion and are woven without interlacing with the weft threads till the starting point of the second stitched surface portion.

In another embodiment of the present invention, the second intermediate warp threads having participated in the formation of the second stitched surface portion are woven to form the second intermediate portion and are woven together with the backing warp threads to form the third stitched backing portion.

In accordance with another aspect of the present invention, there is provided a method for the production of a three-dimensional multilayer fabric comprising a surface layer, a backing layer and an intermediate layer connecting the surface layer and the backing layer, the method comprising the steps of: interlacing surface warp threads and intermediate warp threads with weft threads while shedding along a harness to form a stitched surface portion; interlacing backing warp threads and the intermediate warp threads with the weft threads during shedding to form a stitched backing portion; interlacing the surface warp threads with the weft threads to form an unstitched surface portion; interlacing the intermediate warp threads with the weft threads to form the intermediate layer; interlacing the backing warp threads with the weft threads to form an unstitched backing portion; weaving the intermediate warp threads having participated in the formation of the stitched backing portion without interlacing with the weft threads and moving the intermediate warp threads from any point of the unstitched backing portion to the unstitched surface portion; and sequentially repeating the above procedure as the pre-designed length and shearing the connecting warp threads of the intermediate layer exposed to the outside of the backing layer and the surface layer.

In an embodiment of the present invention, the intermediate layer includes sequential intermediate portions, each consisting of a first intermediate portion and a second intermediate portion, and in the step of forming the stitched surface portion, the surface warp threads and first intermediate warp threads are interlaced with the weft threads while shedding along the harness to form a first stitched surface portion.

In a further embodiment of the present invention, in the step of forming the stitched backing portion, the backing warp threads and second intermediate warp threads are interlaced with the weft threads during shedding to form the second stitched backing portion.

In another embodiment of the present invention, the step of forming the intermediate layer includes the sub-step of interlacing the first intermediate warp threads with the weft threads to form the first intermediate portion.

In another embodiment of the present invention, the step of forming the stitched surface portion includes the sub-step of weaving the second intermediate warp threads with the surface warp threads to form the second stitched surface portion.

In another embodiment of the present invention, the step of forming the stitched backing portion includes the sub-step of weaving the first intermediate warp threads with the backing warp threads to form the second stitched backing portion.

In accordance with another aspect of the present invention, there is provided a method for the production of a three-dimensional multilayer fabric comprising a surface layer, a backing layer, and an intermediate layer connecting the surface layer and the backing layer and including sequential intermediate portions, each consisting of a first intermediate portion and a second intermediate portion, the method comprising the steps of: weaving surface warp threads with first intermediate warp threads to form a first stitched surface portion and weaving the first intermediate warp threads only to form the first intermediate portion; weaving backing warp threads with second intermediate warp threads to form a first stitched backing portion at the same vertical position as the first stitched surface portion, weaving the second intermediate warp threads without interlacing with weft threads, where the backing warp threads only are interlaced with the weft threads to form an unstitched backing portion, and moving the second intermediate warp threads upwardly from any point of the unstitched backing portion to the surface layer; moving the connecting warp threads of the second intermediate portion upwardly from any point of the unstitched backing portion between the first stitched surface portion and the second stitched surface portion to the unstitched surface portion, weaving the connecting warp threads without interlacing with the weft threads, weaving the connecting warp threads with the surface warp threads at the starting point of the second stitched backing portion to form a second stitched surface portion of the surface layer, and weaving the second intermediate warp threads only to form the second intermediate portion; weaving the first intermediate warp threads with the backing warp threads to form a second stitched backing portion, weaving the first intermediate warp threads without interlacing with the weft threads, and weaving the backing warp threads only to form an unstitched backing portion till the starting point of a subsequent stitched backing portion; and shearing the connecting warp threads of the intermediate layer exposed to the outside of the backing layer and the surface layer.

In an embodiment of the present invention, when the surface warp threads are 1/3, the backing warp threads are 2/4, the first intermediate warp threads are 5/7 and the second intermediate warp threads are 6/8, as indicated by harness numbers, the unstitched surface portion and the unstitched backing portion are essentially composed of 1/3 and 2/4, respectively, the first and third stitched surface portions are composed of 1/3/5/7, and the second stitched surface portion is composed of 1/3/6/8, the first and third stitched backing portions of the baking layer are composed of 2/4/6/8, the second stitched backing portion is composed of 2/4/5/7, and the first and second intermediate portions are composed of 5/7 and 6/8, respectively.

In accordance with another aspect of the present invention, there is provided a three-dimensional multilayer fabric, comprising a surface layer, a backing layer and an intermediate layer connecting the surface layer and the backing layer wherein the surface layer includes sequential unstitched surface portions and sequential stitched surface portions formed in an alternating and repeating pattern, the unstitched surface portions being essentially composed of surface warp threads only and the stitched surface portions being composed of the surface warp threads and intermediate warp threads; the backing layer includes sequential unstitched backing portions and sequential stitched backing portions formed in an alternating and repeating pattern, the unstitched backing portions being essentially composed of backing warp threads and the intermediate warp threads; and the intermediate layer includes sequential intermediate portions composed of the intermediate warp threads only, each of the intermediate portions consisting of a first intermediate portion and a second intermediate portion connected to the stitched surface portions and the stitched backing portions in an alternating and repeating pattern, the intermediate warp threads being interlaced with extra weft threads on the surface layer to form protruding portions exposed to the outside, after which the protruding portions are removed to create a three-dimensional shape.

In an embodiment of the present invention, each of the first and second intermediate portions of the intermediate layer is connected to the corresponding stitched surface portion and the subsequent stitched backing portion of the stitched backing portion lying on the same vertical line as the stitched surface portion.

In a further embodiment of the present invention, the surface warp threads only are woven without weaving with the other warp threads to form the unstitched surface portions and are woven with second intermediate warp threads to form the second stitched surface portion.

In another embodiment of the present invention, the second intermediate warp threads only are woven to form the second intermediate portion and are woven together with the surface warp threads to form the second stitched surface portion.

In another embodiment of the present invention, the second intermediate warp threads having participated in the formation of the stitched surface portion are exposed to the upper surface of the surface layer and two extra weft threads are woven upwardly and downwardly with respect to the warp threads to surround the warp threads.

In another embodiment of the present invention, the warp threads having participated in the formation of the protruding portions are moved to the backing layer and are woven together with the backing warp threads to form the unstitched backing portion (zone B) and the third stitched backing portion from the point where the formation of the second stitched backing portion is completed.

In another embodiment of the present invention, the backing warp threads are woven with first intermediate warp threads to form the unstitched backing portion (zone A) and the second stitched backing portion.

In another embodiment of the present invention, the first intermediate warp threads only are woven to form the first intermediate portion and the surface warp threads are woven with the first intermediate warp threads to form the third stitched surface portion.

In another embodiment of the present invention, the first intermediate warp threads having participated in the formation of the unstitched portion are exposed to the upper surface of the surface layer and two extra weft threads are woven upwardly and downwardly with respect to the warp threads to surround the warp threads.

In another embodiment of the present invention, the warp threads having participated in the formation of the protruding portions are moved to the backing layer and are woven together with the backing warp threads to form the unstitched backing portion and the stitched backing portion from the point where the formation of the third stitched backing portion is completed.

In accordance with another aspect of the present invention, there is provided a three-dimensional fabric, comprising a surface layer, a backing layer and an intermediate layer connecting the surface layer and the backing layer wherein the surface layer includes sequential unstitched surface portions and sequential stitched surface portions, the backing layer includes sequential unstitched backing portions and sequential stitched backing portions, and the intermediate layer includes sequential intermediate portions, each consisting of a first intermediate portion and a second intermediate portion; and wherein when surface warp threads are 1/3, backing warp threads are 2/4, first intermediate warp threads are 5/7 and second intermediate warp threads are 6/8, as indicated by harness numbers, the surface layer is composed of 1/3, the first and third stitched surface portions are composed of 1/3/5/7, the second stitched surface portion is composed of 1/3/6/8, the unstitched backing portion till the first stitched backing portion and the stitched portion are composed of 2/4/6/8, the unstitched backing portion till the second stitched backing portion and the stitched portion are composed of 2/4/5/7, the unstitched backing portion till the third stitched backing portion and the stitched portion are composed of 2/4/6/8, the above procedure is sequentially repeated, and protruding portions exposed to the outside of the surface layer are removed.

In an embodiment of the present invention, the warp thread and/or the weft thread is woven with a low-melting point yarn.

In a further embodiment of the present invention, the low-melting point yarn is a grey yarn whose melting point is intentionally lowered by modification of molecular structure, copolymerization, blending, spinning process control or composite spinning so that the surface can be minutely fused by thermal treatment in the temperature range of about 120° C. to about 190° C.

In another embodiment of the present invention, the warp thread and/or the weft thread is a grey yarn in which a low-melting point yarn and a flame-retardant yarn are mixed or a composite fiber composed of a low-melting point portion and a flame-retardant portion.

In another embodiment of the present invention, the ratio between the low-melting point portion (or yarn) and the flame-retardant portion (or yarn) is from 15:85 to 50:50 (w/w).

In another embodiment of the present invention, the fabric is further thermally treated before or after the shearing or before or after removal of the protruding portions exposed to the outside of the backing layer to achieve improved shape stability and enhanced stiffness.

In another embodiment of the present invention, the thermal treatment is performed in the temperature range of 120° C. to 190° C.

In another embodiment of the present invention, the surface layer and the backing layer are formed into a mesh structure by weaving.

In another embodiment of the present invention, the intermediate layer is denser than the surface layer and the backing layer.

In another embodiment of the present invention, the warp threads or the weft threads are positioned at intervals of 0.2 to 2 mm in the surface layer and the backing layer.

In accordance with another aspect of the present invention, there is provided a method for the production of a three-dimensional multilayer fabric comprising a surface layer, a backing layer and an intermediate layer connecting the surface layer and the backing layer, the method comprising the steps of: weaving surface warp threads only to form a stitched surface portion; weaving intermediate warp threads only to form the intermediate layer; weaving the intermediate warp threads with backing warp threads to form an unstitched backing portion; weaving the surface warp threads and the intermediate warp threads to form a stitched surface portion; weaving the intermediate warp threads with the backing warp threads to form a stitched backing portion; exposing the intermediate warp threads to the outside of the surface layer and weaving the exposed intermediate warp threads with extra weft threads to form a protruding portion; and sequentially repeating the above procedure as the pre-designed length and shearing the protruding portions exposed to the outside of the surface layer.

In an embodiment of the present invention, the surface warp threads are woven with second intermediate warp threads to form the second stitched surface portion.

In a further embodiment of the present invention, the intermediate layer includes sequential intermediate portions, each consisting of a first intermediate portion and a second intermediate portion, and the first and second intermediate portions are composed of first intermediate warp threads and second intermediate warp threads, respectively.

In another embodiment of the present invention, the second intermediate warp threads are exposed to the upper surface of the surface layer and two extra weft threads are woven upwardly and downwardly with respect to the warp threads to surround the warp threads.

In another embodiment of the present invention, the second intermediate warp threads having participated in the formation of the protruding portions are moved to the backing layer and are woven together with the backing warp threads to form the unstitched backing portion (zone B) and the third stitched backing portion from the point where the formation of the second stitched backing portion is completed.

In another embodiment of the present invention, the backing warp threads are woven with first intermediate warp threads to form the unstitched backing portion (zone A) and the second stitched backing portion.

In another embodiment of the present invention, the surface warp threads are woven with the first intermediate warp threads to form the first intermediate portion.

In another embodiment of the present invention, the first intermediate warp threads are exposed to the upper surface of the surface layer and two extra weft threads are woven upwardly and downwardly with respect to the warp threads to surround the warp threads.

In another embodiment of the present invention, the warp threads having participated in the formation of the protruding portions are moved to the backing layer and are woven together with the backing warp threads to form the unstitched backing portion and the stitched backing portion from the point where the formation of the third stitched backing portion is completed.

In accordance with another aspect of the present invention, there is provided a method for the production of a three-dimensional multilayer fabric comprising a surface layer, a backing layer and an intermediate layer connecting the surface layer and the backing layer wherein the surface layer includes sequential unstitched surface portions and sequential stitched surface portions, the backing layer includes sequential unstitched backing portions and sequential stitched backing portions, and the intermediate layer includes sequential intermediate portions, each consisting of a first intermediate portion and a second intermediate portion, the method comprising the steps of: weaving first intermediate warp threads (5/7) to form the first intermediate portion (5/7), weaving second intermediate warp threads (6/8) to form the second intermediate portion (6/8), weaving surface warp threads (1/3) to form the surface layer (1/3), weaving the surface warp threads (1/3) and the first intermediate warp threads (5/7) to form the first and third stitched surface portions (1/3/5/7), weaving the surface warp threads (1/3) and the second intermediate warp threads (6/8) to form the second stitched surface portion (1/3/6/8), weaving backing warp threads (2/4) and the second intermediate warp threads (6/8) to form the unstitched backing portion (2/4/6/8) till the first stitched backing portion and the stitched portion (2/4/6/8), weaving the backing warp threads (2/4) and the first intermediate warp threads (5/7) to form the unstitched backing portion (2/4/5/7) till the second stitched backing portion and the stitched portion (2/4/5/7), weaving the backing warp threads (2/4) and the second intermediate warp threads (6/8) to form the unstitched backing portion (2/4/6/8) till the third stitched backing portion and the stitched portion (2/4/6/8) [the numbers in parentheses indicate harness numbers], sequentially repeating the above procedure, and removing protruding portions exposed to the outside of the surface layer.

In an embodiment of the present invention, the warp thread and/or the weft thread is woven with a low-melting point yarn.

In a further embodiment of the present invention, the low-melting point yarn is a grey yarn whose melting point is intentionally lowered by modification of molecular structure, copolymerization, blending, spinning process control or composite spinning so that the surface can be minutely fused by thermal treatment in the temperature range of about 120° C. to about 190° C.

In another embodiment of the present invention, the warp thread and/or the weft thread is a grey yarn in which a low-melting point yarn and a flame-retardant yarn are mixed or a composite fiber composed of a low-melting point portion and a flame-retardant portion.

In another embodiment of the present invention, the ratio between the low-melting point portion (or yarn) and the flame-retardant portion (or yarn) is from 15:85 to 50:50 (w/w).

In another embodiment of the present invention, the fabric is further thermally treated before or after the shearing or before or after removal of the protruding portions exposed to the outside of the backing layer to achieve improved shape stability and enhanced stiffness.

In another embodiment of the present invention, the thermal treatment is performed in the temperature range of 120° C. to 190° C.

In another embodiment of the present invention, the surface layer and the backing layer are formed into a mesh structure by weaving.

In another embodiment of the present invention, the intermediate layer is denser than the surface layer and the backing layer.

In another embodiment of the present invention, the warp threads or the weft threads are positioned at intervals of 0.2 to 2 mm in the surface layer and the backing layer.

The present invention also provides three-dimensional fabrics produced by the methods.

The present invention also provides clothes using the fabrics and clothes using fabrics produced by the methods.

The present invention also provides articles using the fabrics and articles using fabrics produced by the methods.

The present invention also provides blinds using the fabrics and blinds using fabrics produced by the methods.

ADVANTAGEOUS EFFECTS

The fabrics and the methods according to the embodiments of the present invention have the following advantageous effects.

Firstly, the fabrics can be produced by conventional weaving techniques and undergo transformation between two-dimensional and three-dimensional shapes.

Secondly, the design, color depth and light-shielding effects of the fabrics can be effectively varied through the transformation between two-dimensional and three-dimensional shapes.

Thirdly, the shape stability of the fabrics can be maintained without the use of any pressure-sensitive adhesive or adhesive and the need for surface coating. In addition, the fabrics can be produced in a single weaving operation to create three-dimensional shapes.

Fourthly, since the fabrics can maintain inherent flexibility and ensure shape stability, they can find application as materials in industrial fields, such as clothing.

Fifthly, the fabrics comprise stitched surface portions and stitched backing portions formed by weaving rather than by lamination. Accordingly, the fabrics are environmentally friendly and have the advantage that the connected state between the surface layer and the backing layer can be maintained semi-permanently.

Sixthly, low-melting point yarns are woven and thermally treated at a particular temperature when it is intended to use the fabrics as light-shielding materials. Due to the use of the low-melting point yarns, the fabrics exhibit excellent drapability, which is an important characteristic of light-shielding materials, without losing their original texture and are not affected by temperature and humidity, thus eliminating the need for coating.

Finally, the fabrics are highly flame retardant and produce no toxic gases upon combustion.

BRIEF DESCRIPTION OF THE DRAWINGS

FIG. 1 is a cross-sectional view of a fabric according to a preferred embodiment of the present invention along the running direction of warp threads;

FIG. 2 is a conceptual sectional view illustrating the production of the fabric of FIG. 1 by weaving;

FIG. 3 is a conceptual sectional view illustrating the production of the fabric of FIG. 1 by weaving, as indicated by harness numbers;

FIG. 4 is a conceptual sectional view illustrating the production of the fabric of FIG. 1 by weaving after shearing;

FIGS. 5 and 6 are flow charts illustrating the production of the fabric of FIG. 1 by weaving;

FIG. 7 is a conceptual sectional view illustrating the production of a fabric according to a further preferred embodiment of the present invention by weaving;

FIG. 8 is a view illustrating a three-dimensional shape of a fabric according to a preferred embodiment of the present invention;

FIG. 9 is a cross-sectional view of a fabric according to another embodiment of the present invention along the running direction of warp threads;

FIG. 10 is a view illustrating a state in which the connecting warp threads of the fabric of FIG. 9 are removed;

FIG. 11 is a conceptual view illustrating a surface of the fabric of FIG. 9;

FIG. 12 is a view illustrating a state of a fabric according to a preferred embodiment of the present invention during use; and FIGS. 13 and 14 are perspective views of prior art blinds.

BRIEF EXPLANATION OF ESSENTIAL PARTS OF THE DRAWINGS

100: Surface layer 110: Stitched surface portions
120: Unstitched surface portions 200: Backing layer
210: Stitched backing portions 220: Unstitched backing portions
300: Intermediate layer 310: First intermediate portion
320: Second intermediate portion 400: Protruding portions

BEST MODE FOR CARRYING OUT THE INVENTION

Preferred embodiments of the present invention will now be described in detail with reference to the accompanying drawings. It should be noted that whenever possible, the same reference numerals will be used throughout the drawings and the description to refer to the same or like parts. In describing the present invention, detailed descriptions of related known functions or configurations are omitted in order to avoid making the essential subject of the invention unclear.

As used herein, the terms about, substantially, etc. are intended to allow some leeway in mathematical exactness to account for tolerances that are acceptable in the trade and to prevent any unconscientious violator from unduly taking advantage of the disclosure in which exact or absolute numerical values are given so as to help understand the invention.

The term fabrics is defined to include woven fabrics, knitted fabrics, felt fabrics, plaited fabrics, non-woven fabrics, laminated fabrics and molded fabrics. Woven fabrics are exemplified in order to better understand the embodiments of the present invention. Thus, it is to be understood that the woven fabrics are produced by the interlacing of warp threads and weft threads. The expression warp threads only are woven is used herein to mean that the warp threads are interlaced with weft threads, but the expression not interlaced with weft threads is not applied thereto.

FIGS. 1 through 3 illustrate the cross-sectional structures of a fabric according to a preferred embodiment of the present invention. The structures of the fabric will be explained along the running direction of warp threads.

As illustrated in FIG. 1, the fabric has a three-layer structure consisting of a surface layer 100, a backing layer 200 and an intermediate layer 300 connecting the surface layer 100 and the backing layer 200. The actual structure of the fabric is as illustrated in FIG. 1. For ease of understanding and explanation, the surface layer 100 and the backing layer 200 are spaced apart from each other through the intermediate layer 300 (FIGS. 2 and 3).

The surface layer 100 includes stitched surface portions 110 and unstitched surface portions 120 formed in an alternating and repeating pattern, and the backing layer 200 includes stitched backing portions 210 and unstitched backing portions 220 formed in an alternating and repeating pattern. The unstitched surface portions 120 and the unstitched backing portions 220 are composed of surface warp threads and backing warp threads, respectively. The stitched surface portions 110 can be composed of the surface warp threads and intermediate warp threads. The stitched backing portions 210 can be composed of the backing warp threads and the intermediate warp threads. The intermediate layer 300 includes a first intermediate portion 310 and a second intermediate portion 320, which are composed of different kinds of warp threads, i.e. first intermediate warp threads and second intermediate warp threads.

The unstitched surface portions 120 and the unstitched backing portions 220 are essentially composed of independent warp threads (i.e. the surface warp threads and the backing warp threads) without interlacing with other warp threads. Starting from zone A of FIG. 2, the principle of weaving will be explained with regard to the formation of the layers using the respective warp threads. The surface warp threads are woven with the first intermediate warp threads to form a first stitched surface portion 111. The first intermediate warp threads only are woven to form the first intermediate portion 310 and are then woven with the backing warp threads to form a second stitched backing portion 213 of the backing layer 200. Thereafter, the second intermediate warp threads are woven without interlacing with the weft threads and the backing warp threads only are woven to form the unstitched backing portion 220 in zone B. The first intermediate warp threads (connecting warp threads 311) woven without interlacing the weft threads at the starting point of a third stitched surface portion 115 connect the starting point of a third stitched backing portion 215 to the starting point of the third stitched surface portion 115 and are woven together with the surface warp threads to form the third stitched surface portion 115. The subsequent procedure is carried out in the same manner as after the formation of the first stitched surface portion 111.

On the other hand, a first stitched backing portion 211 of the backing layer 200 is formed at the same vertical position as the first stitched surface portion 111. The backing layer 200 is essentially composed of the backing warp threads. The first stitched backing portion 211 is composed of the backing warp threads and the second intermediate warp threads. Thereafter, the second intermediate warp threads are woven without interlacing the weft threads and the backing warp threads are interlaced with the weft threads to form the unstitched baking portion 220 (zone A). The second intermediate warp threads (connecting warp threads 321) woven without interlacing the weft threads are woven together with the surface warp threads at the starting point of the second stitched backing portion 213 to form a second stitched surface portion 113 of the surface layer 100. At this time, the connecting warp threads 321 serve to connect the second stitched surface portion 113 and the second stitched backing portions 213. Herein, the second stitched surface portion 113 may be formed at the same vertical position as the second stitched backing portion 213. The second intermediate warp threads having participated in the formation of the second stitched surface portion 113 are woven with the second intermediate warp threads to form the intermediate layer (herein, the second intermediate portion in zone B) and are woven with the backing warp threads to form the third stitched backing portion 215. The subsequent procedure is carried out in the same manner as in zone A.

In FIG. 3, the method for the production of the fabric by weaving is simplified. As illustrated in FIG. 3, when the surface warp threads are 1/3, the backing warp threads are 2/4, the first intermediate warp threads are 5/7 and the second intermediate warp threads are 6/8, as indicated by harness numbers, the unstitched surface portions 120 and the unstitched backing portions 220 are essentially composed of 1/3 and 2/4, respectively, the first and third stitched surface portions 111 and 115 are composed of 1/3/5/7, and the second stitched surface portion 113 is composed of 1/3/6/8, the first and third stitched backing portions 211 and 215 of the backing layer are composed of 2/4/6/8, the second stitched backing portion 213 is composed of 2/4/5/7, and the first and second intermediate portions 310 and 320 are composed of 5/7 and 6/8, respectively.

Referring to FIGS. 2 and 3, the production of the fabric according to the present invention will be explained in accordance with the actual weaving procedure. First, the surface warp threads and the first intermediate warp threads are once interlaced with the weft threads while shedding along a harness to form the first stitched surface portion 111. Thereafter, the backing warp threads and the second intermediate warp threads are interlaced with the weft threads during shedding to form the second stitched backing portion. This procedure is sequentially and repeatedly continued until the respective stitched portions are formed in accordance with the pre-designed length (for example, 1 cm) of the stitched portions.

After the formation of the stitched portions 111 and 211 is completed, the surface warp threads only are interlaced with the weft threads to form the unstitched surface portion 120 in zone A and the first intermediate warp threads only are interlaced with the weft threads to form the first intermediate portion. Further, the backing warp threads only are interlaced with the weft threads to form the unstitched backing portion 220. This procedure is sequentially and repeatedly continued as the pre-designed length just before the respective second stitched portions are formed.

The weaving in zone B is the same as in zone A except that different kinds of warp threads are used. The second intermediate warp threads are woven with the surface warp threads to form the second stitched surface portion 113 and the first intermediate warp threads are woven with the backing warp threads to form the second stitched backing portion 213. Thereafter, the surface warp threads are woven to form the unstitched surface portion, the second intermediate warp threads are woven to form the second intermediate portion 320, and the backing warp threads are woven to form the unstitched backing portion. These portions are formed sequentially and repeatedly by weaving in the same manner as in zone A.

The interlacing between the warp threads and the weft threads is basically conducted once, but the number of interlacing may vary in each layer depending on the fineness and texture of the threads. In addition, the surface layer is first formed by weaving, but it should be understood that the intermediate layer or the backing layer can be formed before the surface layer (see, FIGS. 5 and 6).

The surface layer is connected to the backing layer by the connecting warp threads 311 and 321, thus making it impossible to create a three-dimensional shape. Accordingly, the removal of the connecting warp threads 311 and 321 is required to create a three-dimensional shape. FIG. 4 illustrates a state in which the connecting warp threads 311 and 321 are removed. By the removal of the connecting warp threads, the surface layer 100 and the backing layer 200 are connected to each other in an alternating manner through the intermediate layer 300. This alternating connection allows the fabric to create a three-dimensional shape. Specifically, the first stitched surface portion 111 is connected to the second stitched backing portion 213 through the first intermediate portion 310, and the second stitched surface portion 113 is connected to the third stitched backing portion 215 through the second intermediate portion 320. This structure may be repeated in a continuous pattern.

FIG. 7 is a conceptual view illustrating the production of a fabric according to another preferred embodiment of the present invention. The basic principle of weaving is the same as in the fabric of the previous embodiment except that the connecting warp threads 311 and 321 are stitched at different points. First, the weaving in zone A will be explained. The second intermediate warp threads having participated in the formation of the first stitched backing portion 211 are woven without interlacing with the weft threads to form the unstitched backing portion 220 in sub-zone (a), as explained in the previous embodiment. In the embodiment of FIG. 1, the second intermediate warp threads are moved to the surface layer 100 and are woven together with the surface warp threads at the starting point of the second stitched backing portion 213 to form the second stitched surface portion 113. In the present embodiment, the second intermediate warp threads are moved from any point of the zone, where the unstitched backing portion 220 only is formed, to the surface layer 110, and are woven without interlacing with the weft threads in sub-zone (b) of the unstitched surface portion 120 to form the second stitched surface portion 113. Thereafter, the second intermediate warp threads are woven together with surface warp threads in the zone where the second stitched surface portion 113 is formed, as described in the previous embodiment. The weaving of the first intermediate warp threads is also carried out in the same manner as in the previous embodiment.

Some of the warp threads that are not interlaced with the weft threads are exposed to the surfaces of the surface layer and the backing layer. In the previous embodiment, some of the warp threads that are not interlaced with the weft threads are exposed to the surface of the backing layer.

Since the surface layer is connected to the backing layer by the connecting warp threads 311 and 321, the removal of the connecting warp threads 311 and 321 is required to create a three-dimensional shape. The fabric of the present embodiment has the advantage that the introduction of the connecting warp threads arising from the random movement of fibers after cutting can be prevented.

The connecting warp threads can be removed by various methods, for example, shearing. Specifically, some of the warp threads exposed from the backing layer 200 without interlacing with the weft threads can be cut and removed by suction.

FIG. 8 is a schematic view illustrating the state of a fabric according to a preferred embodiment of the present invention during use. FIG. 1 illustrates a state in which a three-dimensional shape is not created in the fabric, whereas FIG. 8 illustrates a state in which the surface layer moves upward to create a three-dimensional shape in the fabric.

The fabric may be thermally treated before or after the shearing to achieve improved shape stability and enhanced stiffness. The thermal treatment is preferably carried out before shearing to make the fabric stiffer. When the thermal treatment is carried out after shearing, an excessive stress (e.g., cutting) is applied to the fabric in the state where the multiple layers are adhered, and as a result, the fabric may be damaged.

To avoid damage to the fabric, the warp thread and/or the weft thread is woven with a low-melting point yarn. As the low-melting point yarn, there may be used a grey yarn whose melting point is intentionally lowered by modification of molecular structure, copolymerization, blending, spinning process control or composite spinning so that the surface can be minutely fused by thermal treatment in the temperature range of about 120° C. to about 190° C. Specifically, as the grey yarn, Korean Patent No. 289414 suggests a copolyester-based binder fiber prepared by copolymerizing terephthalic acid or its ester-forming derivative, ethylene glycol and neopentyl glycol. Further, the low-melting yarn produced by composite spinning is composed of a core portion and a sheath portion. The core portion serves as a support and the sheath portion is fused during thermal treatment. As the low-melting yarn, Korean Patent No. 587122 suggests a heat-fusible composite fiber comprising a low-melting point ingredient and a high-melting point ingredient wherein the low-melting point ingredient forms continuously at least a part of the fiber surface in the fiber direction, has a glass transition temperature higher than 60° C. and is composed of a mixture of 1 to 20 wt % of polyolefin and 80 to 99 wt % of a copolyester having 50 to 70 mol % of polyethylene terephthalate units.

As the warp thread and/or the weft thread, there can be used a mixture in which a low-melting point yarn and a flame-retardant yarn are mixed, a composite fiber (e.g., sheath-core type, split type, multiple sea-island type, etc.) composed of a low-melting point portion and a flame-retardant portion, or a blended spun yarn of a low-melting point yarn and a flame retardant yarn. In this case, the fabrics can be utilized as industrial materials, particularly, curtain sheets and blinds. At this time, the ratio between the low-melting point portion and the flame-retardant portion or between the low-melting point yarn and the flame-retardant yarn is preferably from 15:85 to 50:50 (w/w). When the flame retardant portion (or yarn) is present in the amount of less than 50 wt %, the flame retardance of the fabric is deteriorated. Meanwhile, when the flame retardant portion (or yarn) is present in the amount exceeding 85%, the degree of fusion of the flame retardant portion (or yarn) during thermal treatment is low, and as a result, improvement in the stiffness of the fabric is negligible.

FIGS. 9 through 11 illustrate a fabric according to a preferred embodiment of the present invention. The weaving and the basic structure of the fabric are the same as the foregoing embodiments except that the intermediate warp threads run in different directions during weaving.

First, the surface warp threads are woven without interlacing with the other warp threads to form the unstitched surface portion 120 of the surface layer 100 and are then woven with the second intermediate warp threads to form the second stitched surface portion 113 in zone A. The formation of the second intermediate portion 320 by weaving the second intermediate warp threads only is the same as in the foregoing embodiments. Thereafter, the connecting warp threads 321 of the second intermediate portion 320 are exposed to the surface of the surface layer to form protruding portions 400. As illustrated in the enlarged partial view of the FIG. 9, two weft threads are woven upwardly and downwardly with respect to the warp threads 321 to surround the warp threads 321. The connecting warp threads 321 interlaced with the weft threads are woven together with the backing warp threads to form the backing layer 200 and are woven together with the backing warp threads to form the third stitched backing portion 215 in zone B. Again, the backing warp threads are woven together with the first intermediate warp threads to form the backing layer 200 and are then woven with the first intermediate warp threads to form the second stitched backing portion 213 in zone A. Thereafter, the first intermediate warp threads are woven to form the first intermediate portion 310, woven with the surface warp threads to form the third stitched surface portion 115 and woven with extra weft threads to form protruding portions 400 exposed to the surface of the third stitched surface portion 115 in zone B. The first intermediate warp threads are woven with the backing warp threads to form the backing layer after the third stitched backing portion 215. That is, in the present embodiment, the first or second intermediate warp threads are woven with the backing warp threads to form the unstitched backing portions 220 and the stitched backing portions 210 of the backing layer, and the second or first intermediate warp threads are woven with the backing warp threads to form the unstitched backing portions 220 and the stitched backing portions 210 of the backing layer in an alternating and repeating pattern in the other zone.

In FIG. 10, the method for the production of the fabric by weaving is simplified. As illustrated in FIG. 10, when the surface warp threads are 1/3, the backing warp threads are 2/4, the first intermediate warp threads are 5/7 and the second intermediate warp threads are 6/8, as indicated by harness numbers, the surface layer 100 is essentially composed of 1/3, the first and third stitched surface portions 111 and 115 are composed of 1/3/5/7, the second stitched surface portion 113 is composed of 1/3/6/8, the unstitched backing layer till the first stitched backing portion 211 and the stitched portion 211 are composed of 2/4/6/8, the unstitched backing layer till the second stitched backing portion 213 and the stitched portion 213 are composed of 21415/7, the unstitched backing layer till the third stitched backing portion 215 and the stitched portion 215 are composed of 2/4/6/8. The above procedure is sequentially repeated. The first and second intermediate portions are composed of 5/7 and 6/8, respectively.

Since the surface layer is connected to the backing layer by the connecting warp threads 311 and 321, it is necessary to remove the connecting warp threads. As mentioned earlier, the connecting warp threads can be removed by shearing. Alternatively, the connecting warp threads can be removed in a more convenient manner by removing the warp threads 400 exposed to the surface layer. That is, the connecting warp threads exposed to the surface layer are fixed by the weft threads. The weft threads are continuously exposed together with the connecting warp threads in the width direction (see, FIG. 11). When it is intended to move upwardly and remove the weft threads exposed to the surface layer, the connecting warp threads interlaced together with the weft threads are also moved upwardly and cut at the respective stitched portions. As a result, the connecting warp threads can be completely removed together with the weft threads.

In the fabrics according to the present invention, the surface layer, the backing layer and the intermediate layer may have different texture densities. For example, the surface layer and the backing layer are configured to have a mesh structure by weaving, and the intermediate layer is configured to be denser than the surface layer and the backing layer. When the fabric has a structure in which the inner and outer portions are not exposed, as illustrated in FIG. 1, it does not create a three-dimensional shape. When the fabric has a structure in which the intermediate layer is movable in the vertical direction with respect to the surface layer and the backing layer and the inner and outer portions of the layers are exposed due to the mesh structure of the surface layer and the backing layer, as illustrated in FIG. 8, it can create a three-dimensional shape. This structure indicates that the fabric can be utilized as a material for light shielding or security. In addition, the fabric can impart new functions to clothes. When the warp threads and the weft threads in the surface layer and the backing layer are positioned at intervals of 0.2 to 2 mm, more desirable effects of the fabric can be attained. Further, it is to be appreciated that the texture structure and design of the surface layer, the backing layer and the intermediate layer can be varied.

Although the present invention has been described herein with reference to the foregoing embodiments and the accompanying drawings, the scope of the present invention is not limited to the embodiments and drawings. Therefore, it will be evident to those skilled in the art that various substitutions, modifications and changes are possible, without departing from the scope and spirit of the invention as disclosed in the accompanying claims.

The invention claimed is:

1. A three-dimensional multilayer fabric, comprising a surface layer, a backing layer and an intermediate layer connecting the surface layer and the backing layer wherein the surface layer includes sequential unstitched surface portions and sequential stitched surface portions formed in an alternating and repeating pattern, the unstitched surface portions being essentially composed of surface warp threads only and the stitched surface portions being composed of the surface warp threads and intermediate warp threads; the backing layer includes sequential unstitched backing portions and sequential stitched backing portions formed in an alternating and repeating pattern, the unstitched backing portions being essentially composed of backing warp threads only and the stitched backing portions being composed of the backing warp threads and the intermediate warp threads; and the intermediate layer includes sequential intermediate portions composed of the intermediate warp threads only, each of the intermediate portions consisting of a first intermediate portion and a second intermediate portion connected to the stitched surface portions and the stitched backing portions in an alternating and repeating pattern, the intermediate warp threads being woven without interlacing with weft threads on the surfaces of the unstitched backing portions and exposed to the outside, followed by shearing.

2. The three-dimensional fabric according to claim 1, wherein each of the first and second intermediate portions of the intermediate layer is connected to the corresponding stitched surface portion and the subsequent stitched backing portion of the stitched backing portion lying on the same vertical line as the stitched surface portion.

3. The three-dimensional fabric according to claim 2, wherein the surface warp threads are woven with the first intermediate warp threads to form the first stitched surface portion, and the first intermediate warp threads only are woven to form the intermediate layer and are woven with the backing warp threads to form the second stitched backing portion.

4. The three-dimensional fabric according to claim 3, wherein the first intermediate warp threads are woven without interlacing with the weft threads, where the backing warp threads only are woven to form the unstitched backing portions.

5. The three-dimensional fabric according to claim 4, wherein the connecting warp threads of the first intermediate portion connect the starting point of the third stitched backing portion to the starting point of the third stitched surface portion and are woven together with the surface warp threads to form the third stitched surface portion.

6. The three-dimensional fabric according to claim 5, wherein the first stitched backing portion of the backing layer is formed at the same vertical position as the first stitched surface portion and is composed of the backing warp threads and the second intermediate warp threads, and the second intermediate warp threads are woven without interlacing with the weft threads.

7. The three-dimensional fabric according to claim 6, wherein the connecting warp threads of the second intermediate portion are woven together with the surface warp threads at the starting point of the second stitched backing portion to form the second stitched surface portion of the surface layer.

8. The three-dimensional fabric according to claim 7, wherein the second intermediate warp threads having participated in the formation of the second stitched surface portion are woven to form the second intermediate portion and are woven together with the backing warp threads to form the third stitched backing portion.

9. A three-dimensional fabric, comprising a surface layer, a backing layer and an intermediate layer connecting the surface layer and the backing layer wherein the surface layer includes sequential unstitched surface portions and sequential stitched surface portions, the backing layer includes sequential unstitched backing portions and sequential stitched backing portions, and the intermediate layer includes sequential intermediate portions, each consisting of a first intermediate portion and a second intermediate portion; and wherein when surface warp threads are 1/3, backing warp threads are 2/4, first intermediate warp threads are 5/7 and second intermediate warp threads are 6/8, as indicated by harness numbers, the unstitched surface portions and the unstitched backing portions are essentially composed of 1/3 and 2/4, respectively, the first and third stitched surface portions are composed of 1/3/5/7, and the second stitched surface portion is composed of 1/3/6/8, the first and third stitched backing portions of the baking layer are composed of 2/4/6/8, the second stitched backing portion is composed of 2/4/5/7, and the first and second intermediate portions are composed of 5/7 and 6/8, respectively, the connecting warp threads of the intermediate layer exposed to the outside of the backing layer being sheared.

10. A method for the production of a three-dimensional multilayer fabric comprising a surface layer, a backing layer and an intermediate layer connecting the surface layer and the backing layer, the method comprising the steps of: interlacing surface warp threads and intermediate warp threads with weft threads while shedding along a harness to form a stitched surface portion; interlacing backing warp threads and the intermediate warp threads with the weft threads during shedding to form a stitched backing portion; interlacing the surface warp threads with the weft threads to form an unstitched surface portion; interlacing the intermediate warp threads with the weft threads to form the intermediate layer; interlacing the backing warp threads with the weft threads to form an unstitched backing portion; and sequentially repeating the above procedure as the pre-designed length and shearing the connecting warp threads of the intermediate layer exposed to the outside of the backing layer.

11. The method according to claim 10, wherein the intermediate layer includes sequential intermediate portions, each consisting of a first intermediate portion and a second intermediate portion, and in the step of forming the stitched surface portion, the surface warp threads and first intermediate warp threads are interlaced with the weft threads while shedding along the harness to form the first stitched surface portion.

12. The method according to claim 11, wherein, in the step of forming the stitched backing portion, the backing warp threads and second intermediate warp threads are interlaced with the weft threads during shedding to form the second stitched backing portion.

13. The method according to claim 12, wherein the step of forming the intermediate layer includes the sub-step of interlacing the first intermediate warp threads with the weft threads to form the first intermediate portion.

14. The method according to claim 13, wherein the step of forming the stitched surface portion includes the sub-step of weaving the second intermediate warp threads with the surface warp threads to form the second stitched surface portion.

15. The method according to claim 14, wherein the step of forming the stitched backing portion includes the sub-step of weaving the first intermediate warp threads with the backing warp threads to form the second stitched backing portion.

16. A method for the production of a three-dimensional multilayer fabric comprising a surface layer, a backing layer, and an intermediate layer connecting the surface layer and the backing layer and including sequential intermediate portions, each of the intermediate portions consisting of a first intermediate portion and a second intermediate portion, the method comprising the steps of: weaving surface warp threads with first intermediate warp threads to form a first stitched surface portion and weaving the first intermediate warp threads only to form the first intermediate portion; weaving backing warp threads with second intermediate warp threads to form a first stitched backing portion at the same vertical position as the first stitched surface portion, and weaving the second intermediate warp threads without interlacing with the weft threads, where the backing warp threads only are interlaced with the weft threads to form the backing layer; weaving the connecting warp threads of the second intermediate portion with the surface warp threads at the starting point of a second stitched backing portion to form a second stitched surface portion of the surface layer, and weaving the second intermediate warp threads only to form the second intermediate portion; weaving the first intermediate warp threads with the backing warp threads to form a second stitched backing portion and weaving the first intermediate warp threads without interlacing with the weft threads, where the backing warp threads only are woven to form unstitched backing portions; and shearing the connecting warp threads of the intermediate layer exposed to the outside of the backing layer.

17. The method according to claim 16, wherein when the surface warp threads are 1/3, the backing warp threads are 2/4, the first intermediate warp threads are 5/7 and the second intermediate warp threads are 6/8, as indicated by harness numbers, the unstitched surface portion and the unstitched backing portion are essentially composed of 1/3 and 2/4, respectively, the first and third stitched surface portions are composed of 1/3/5/7, and the second stitched surface portion is composed of 1/3/6/8, the first and third stitched backing portions of the baking layer are composed of 2/4/6/8, the second stitched backing portion is composed of 2/4/5/7, and the first and second intermediate portions are composed of 5/7 and 6/8, respectively.

18. A three-dimensional multilayer fabric, comprising a surface layer, a backing layer and an intermediate layer connecting the surface layer and the backing layer wherein the surface layer includes sequential unstitched surface portions and sequential stitched surface portions formed in an alternating and repeating pattern, the unstitched surface portions being essentially composed of surface warp threads only and the stitched surface portions being composed of the surface warp threads and intermediate warp threads; the backing layer includes sequential unstitched backing portions and sequential stitched backing portions formed in an alternating and repeating pattern, the unstitched backing portions being essentially composed of backing warp threads only and the stitched backing portions being composed of the backing warp threads and the intermediate warp threads; and the intermediate layer includes sequential intermediate portions composed of the intermediate warp threads only, each of the intermediate portions consisting of a first intermediate portion and a second intermediate portion connected to the stitched surface portions and the stitched backing portions in an alternating and repeating pattern, the intermediate warp threads being woven without interlacing with weft threads on the surfaces of the unstitched backing portions and the unstitched surface portions and exposed to the outside, followed by shearing.

19. A method for the production of a three-dimensional multilayer fabric comprising a surface layer, a backing layer and an intermediate layer connecting the surface layer and the backing layer, the method comprising the steps of: interlacing surface warp threads and intermediate warp threads with weft threads while shedding along a harness to form a stitched surface portion; interlacing backing warp threads and the intermediate warp threads with the weft threads during shedding to form a stitched backing portion; interlacing the surface warp threads with the weft threads to form an unstitched surface portion; interlacing the intermediate warp threads with the weft threads to form the intermediate layer; interlacing the backing warp threads with the weft threads to form an unstitched backing portion; weaving the intermediate warp threads having participated in the formation of the stitched backing portion without interlacing with the weft threads and moving the intermediate warp threads from any point of the unstitched backing portion to the unstitched surface portion; and sequentially repeating the above procedure as the pre-designed length and shearing the connecting warp threads of the intermediate layer exposed to the outside of the backing layer and the surface layer.

20. A method for the production of a three-dimensional multilayer fabric comprising a surface layer, a backing layer, and an intermediate layer connecting the surface layer and the backing layer and including sequential intermediate portions, each consisting of a first intermediate portion and a second intermediate portion, the method comprising the steps of: weaving surface warp threads with first intermediate warp threads to form a first stitched surface portion and weaving the first intermediate warp threads only to form the first intermediate portion; weaving backing warp threads with second intermediate warp threads to form a first stitched backing portion at the same vertical position as the first stitched surface portion, weaving the second intermediate warp threads without interlacing with weft threads, where the backing warp threads only are interlaced with the weft threads to form an unstitched backing portion, and moving the second intermediate warp threads upwardly from any point of the unstitched backing portion to the surface layer; moving the connecting warp threads of the second intermediate portion upwardly from any point of the unstitched backing portion between the first stitched surface portion and the second stitched surface portion to the unstitched surface portion, weaving the connecting warp threads without interlacing with the weft threads, weaving the connecting warp threads with the surface warp threads at the starting point of the second stitched backing portion to form a second stitched surface portion of the surface layer, and weaving the second intermediate warp threads only to form the second intermediate portion; weaving the first intermediate warp threads with the backing warp threads to form a second stitched backing portion, weaving the first intermediate warp threads without interlacing with the weft threads, and weaving the backing warp threads only to form an unstitched backing portion till the starting point of a subsequent stitched backing portion; and shearing the connecting warp threads of the intermediate layer exposed to the outside of the backing layer and the surface layer.

21. The method according to claim 20, wherein when the surface warp threads are 1/3, the backing warp threads are 2/4, the first intermediate warp threads are 5/7 and the second intermediate warp threads are 6/8, as indicated by harness numbers, the unstitched surface portion and the unstitched backing portion are essentially composed of 1/3 and 2/4, respectively, the first and third stitched surface portions are composed of 1/3/5/7, and the second stitched surface portion is composed of 1/3/6/8, the first and third stitched backing portions of the baking layer are composed of 2/4/6/8, the second stitched backing portion is composed of 2/4/5/7, and the first and second intermediate portions are composed of 5/7 and 6/8, respectively.

22. A three-dimensional multilayer fabric, comprising a surface layer, a backing layer and an intermediate layer connecting the surface layer and the backing layer wherein the surface layer includes sequential unstitched surface portions and sequential stitched surface portions formed in an alternating and repeating pattern, the unstitched surface portions being essentially composed of surface warp threads only and the stitched surface portions being composed of the surface warp threads and intermediate warp threads; the backing layer includes sequential unstitched backing portions and sequential stitched backing portions formed in an alternating and repeating pattern, the unstitched backing portions being essentially composed of backing warp threads and the intermediate warp threads; and the intermediate layer includes sequential intermediate portions composed of the intermediate warp threads only, each of the intermediate portions consisting of a first intermediate portion and a second intermediate portion connected to the stitched surface portions and the stitched backing portions in an alternating and repeating pattern, the intermediate warp threads being interlaced with extra weft threads on the surface layer to form protruding portions exposed to the outside, after which the protruding portions are removed to create a three-dimensional shape.

23. The three-dimensional fabric according to claim 22, wherein each of the first and second intermediate portions of the intermediate layer is connected to the corresponding stitched surface portion and the subsequent stitched backing portion of the stitched backing portion lying on the same vertical line as the stitched surface portion.

24. The three-dimensional fabric according to claim 23, wherein the surface warp threads only are woven without weaving with the other warp threads to form the unstitched surface portions and are woven with second intermediate warp threads to form the second stitched surface portion.

25. The three-dimensional fabric according to claim 24, wherein the second intermediate warp threads only are woven to form the second intermediate portion and are woven together with the surface warp threads to form the second stitched surface portion.

26. The three-dimensional fabric according to claim 25, wherein the second intermediate warp threads having participated in the formation of the stitched surface portion are exposed to the upper surface of the surface layer and two extra weft threads are woven upwardly and downwardly with respect to the warp threads to surround the warp threads.

27. The three-dimensional fabric according to claim 26, wherein the warp threads having participated in the formation of the protruding portions are moved to the backing layer and are woven together with the backing warp threads to form the unstitched backing portion (zone B) and the third stitched backing portion from the point where the formation of the second stitched backing portion is completed.

28. The three-dimensional fabric according to claim 27, wherein the backing warp threads are woven with first intermediate warp threads to form the unstitched backing portion (zone A) and the second stitched backing portion.

29. The three-dimensional fabric according to claim 28, wherein the first intermediate warp threads only are woven to form the first intermediate portion and the surface warp threads are woven with the first intermediate warp threads to form the third stitched surface portion.

30. The three-dimensional fabric according to claim 29, wherein the first intermediate warp threads having participated in the formation of the unstitched portion are exposed to the upper surface of the surface layer and two extra weft threads are woven upwardly and downwardly with respect to the warp threads to surround the warp threads.

31. The three-dimensional fabric according to claim 30, wherein the warp threads having participated in the formation of the protruding portions are moved to the backing layer and are woven together with the backing warp threads to form the unstitched backing portion and the stitched backing portion from the point where the formation of the third stitched backing portion is completed.

32. A three-dimensional fabric, comprising a surface layer, a backing layer and an intermediate layer connecting the surface layer and the backing layer wherein the surface layer includes sequential unstitched surface portions and sequential stitched surface portions, the backing layer includes sequential unstitched backing portions and sequential stitched backing portions, and the intermediate layer includes sequential intermediate portions, each consisting of a first intermediate portion and a second intermediate portion; and wherein when surface warp threads are 1/3, backing warp threads are 2/4, first intermediate warp threads are 5/7 and second intermediate warp threads are 6/8, as indicated by harness numbers, the surface layer is composed of 1/3, the first and third stitched surface portions are composed of 1/3/5/7, the second stitched surface portion is composed of 1/3/6/8, the unstitched backing portion till the first stitched backing portion and the stitched portion are composed of 2/4/6/8, the unstitched backing portion till the second stitched backing portion and the stitched portion are composed of 2/4/5/7, the unstitched backing portion till the third stitched backing portion and the stitched portion are composed of 2/4/6/8, the above procedure is sequentially repeated, and protruding portions exposed to the outside of the surface layer are removed.

33. The three-dimensional fabric according to claim 1, wherein the warp thread and/or the weft thread is woven with a low-melting point yarn.

34. The three-dimensional fabric according to claim 33, wherein the low-melting point yarn is a grey yarn whose melting point is intentionally lowered by modification of molecular structure, copolymerization, blending, spinning process control or composite spinning so that the surface is allowed to be minutely fused by thermal treatment in the temperature range of about 120° C. to about 190° C.

35. The three-dimensional fabric according to claim 1, wherein the fabric is further thermally treated before or after the shearing or before or after removal of the protruding portions exposed to the outside of the backing layer to achieve improved shape stability and enhanced stiffness.

36. The three-dimensional fabric according to claim 1, wherein the intermediate layer is denser than the surface layer and the backing layer.

37. A method for the production of a three-dimensional multilayer fabric comprising a surface layer, a backing layer and an intermediate layer connecting the surface layer and the backing layer, the method comprising the steps of: weaving surface warp threads only to form a stitched surface portion; weaving intermediate warp threads only to form the intermediate layer; weaving the intermediate warp threads with backing warp threads to form an unstitched backing portion; weaving the surface warp threads and the intermediate warp threads to form a stitched surface portion; weaving the intermediate warp threads with the backing warp threads to form a stitched backing portion; exposing the intermediate warp threads to the outside of the surface layer and weaving the exposed intermediate warp threads with extra weft threads to form a protruding portion; and sequentially repeating the above procedure as the pre-designed length and shearing the protruding portions exposed to the outside of the surface layer.

38. The method according to claim 37, wherein the surface warp threads are woven with second intermediate warp threads to form the second stitched surface portion.

39. The method according to claim 38, wherein the intermediate layer includes sequential intermediate portions, each consisting of a first intermediate portion and a second intermediate portion, and the first and second intermediate portions are composed of first intermediate warp threads and second intermediate warp threads, respectively.

40. The method according to claim 39, wherein the second intermediate warp threads are exposed to the upper surface of the surface layer and two extra weft threads are woven upwardly and downwardly with respect to the warp threads to surround the warp threads.

41. The method according to claim 40, wherein the second intermediate warp threads having participated in the formation of the protruding portions are moved to the backing layer and are woven together with the backing warp threads to form the unstitched backing portion (zone B) and the third stitched backing portion from the point where the formation of the second stitched backing portion is completed.

42. The method according to claim 41, wherein the backing warp threads are woven with first intermediate warp threads to form the unstitched backing portion (zone A) and the second stitched backing portion.

43. The method according to claim 42, wherein the surface warp threads are woven with the first intermediate warp threads to form the first intermediate portion.

44. The method according to claim 43, wherein the first intermediate warp threads are exposed to the upper surface of the surface layer and two extra weft threads are woven upwardly and downwardly with respect to the warp threads to surround the warp threads.

45. The method according to claim 44, wherein the warp threads having participated in the formation of the protruding portions are moved to the backing layer and are woven together with the backing warp threads to form the unstitched backing portion and the stitched backing portion from the point where the formation of the third stitched backing portion is completed.

46. A method for the production of a three-dimensional multilayer fabric comprising a surface layer, a backing layer and an intermediate layer connecting the surface layer and the backing layer wherein the surface layer includes sequential unstitched surface portions and sequential stitched surface portions, the backing layer includes sequential unstitched backing portions and sequential stitched backing portions, and the intermediate layer includes sequential intermediate portions, each consisting of a first intermediate portion and a second intermediate portion, the method comprising the steps of: weaving first intermediate warp threads (5/7) to form the first intermediate portion (5/7), weaving second intermediate warp threads (6/8) to form the second intermediate portion (6/8), weaving surface warp threads (1/3) to form the surface layer (1/3), weaving the surface warp threads (1/3) and the first intermediate warp threads (5/7) to form the first and third stitched surface portions (1/3/5/7), weaving the surface warp threads (1/3) and the second intermediate warp threads (6/8) to form the second stitched surface portion (1/3/6/8), weaving backing warp threads (2/4) and the second intermediate warp threads (6/8) to form the unstitched backing portion (2/4/6/8) till the first stitched backing portion and the stitched portion (2/4/6/8), weaving the backing warp threads (2/4) and the first intermediate warp threads (5/7) to form the unstitched backing portion (2/4/5/7) till the second stitched backing portion and the stitched portion (2/4/5/7), weaving the backing warp threads (2/4) and the second intermediate warp threads (6/8) to form the unstitched backing portion (2/4/6/8) till the third stitched backing portion and the stitched portion (2/4/6/8) [the numbers in parentheses indicate harness numbers], sequentially repeating the above procedure, and removing protruding portions exposed to the outside of the surface layer.

47. The method according to claim 10, wherein the warp thread and/or the weft thread is woven with a low-melting point yarn.

48. The method according to claim 10, wherein the fabric is further thermally treated before or after the shearing or before or after removal of the protruding portions exposed to the outside of the backing layer to achieve improved shape stability and enhanced stiffness.

49. The method according to claim 10, wherein the intermediate layer is denser than the surface layer and the backing layer.

* * * * *